US006766737B2

(12) United States Patent
Glöckner et al.

(10) Patent No.: US 6,766,737 B2
(45) Date of Patent: Jul. 27, 2004

(54) METHOD FOR CONTROLLING A CIRCUMFERENTIAL REGISTER IN A WEB-FED ROTARY PRESS

(75) Inventors: Erhard Herbert Glöckner, Eibelstadt (DE); Reinhard Georg Gross, Dettelbach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/416,526

(22) PCT Filed: Nov. 21, 2001

(86) PCT No.: PCT/DE01/04368

§ 371 (c)(1),
(2), (4) Date: May 27, 2003

(87) PCT Pub. No.: WO02/42075

PCT Pub. Date: May 30, 2002

(65) Prior Publication Data

US 2004/0020391 A1 Feb. 5, 2004

(30) Foreign Application Priority Data

Nov. 27, 2000 (DE) ..... 100 58 841

(51) Int. Cl.[7] ..... B41F 13/54

(52) U.S. Cl. ..... 101/228; 101/231; 101/248; 101/180; 400/618; 226/38; 226/42

(58) Field of Search ..... 101/228, 232, 101/216, 248, 486, 180, 181, 231; 400/618; 226/38, 42

(56) References Cited

U.S. PATENT DOCUMENTS 3,561,654 A * 2/1971 Greiner ..... 226/25
4,722,275 A * 2/1988 Taguchi et al. ..... 101/228
5,052,296 A * 10/1991 Shiba ..... 101/227
5,937,756 A * 8/1999 Kishine et al. ..... 101/228
6,092,466 A 7/2000 Koch et al.
6,106,177 A 8/2000 Siegl et al.
6,213,367 B1 4/2001 Flamm
6,546,871 B1 * 4/2003 Glockner ..... 101/484
2001/0011508 A1 * 8/2001 Theuner ..... 101/228

FOREIGN PATENT DOCUMENTS

| | | |
|---|---|---|
| DE | 2 262 720 | 11/1972 |
| DE | 198 34 725 | 7/1998 |
| EP | 0 914 944 | 5/1999 |
| EP | 0 933 201 | 8/1999 |
| EP | 0 950 519 | 10/1999 |
| EP | 0 951 993 | 10/1999 |
| EP | 1 048 459 | 11/2000 |
| WO | WO 00/34042 | 6/2000 |

* cited by examiner

*Primary Examiner*—Andrew H. Hirshfeld
*Assistant Examiner*—Kevin Williams
(74) *Attorney, Agent, or Firm*—Jones, Tullar & Cooper P.C.

(57) ABSTRACT

The circumferential register of a web passing through printing units of a web-fed rotary press is accomplished by determining an actual value of the tension in the web. An angular position or an angular velocity of a cylinder of a first print unit, with respect to a cylinder of a second print unit, is varied based on this determined tension. This corrects any register offset without the need to control web tension and without the use of an optical recognition system. The value of the needed change for the cylinder angular position or velocity is determined as a function of the measured tension of the web.

25 Claims, 2 Drawing Sheets

01

22
26
28
S5
S5
21
ΔS
27
08
11
S04
ΔΦ̇
ΔΦ
07
19
S03
24
K
K
18
ΔΦ
06
S02
09
13
14
04
12
17
K
S01
16
K
03
23
02

METHOD FOR CONTROLLING A CIRCUMFERENTIAL REGISTER IN A WEB-FED ROTARY PRESS

FIELD OF THE INVENTION

The present invention is directed to a method for regulating a circumferential register in a web-fed rotary printing press. An actual web tension passing through at least two print units of the press is used to regulate the circumferential register.

BACKGROUND OF THE INVENTION

A regulation of the transverse and linear register in a press is known from EP 0 951 993 A1. The correction of the transverse register is performed by use of a traction roller. A change in the web's linear expansion is determined by use of web speeds and other parameters, such as tension-expansion diagrams and set values of tension. This change is transmitted back to regulation arrangements for cylinders of the printing groups and/or for an actuator for setting and correcting the cutting register.

WO 00/34042 discloses a method for regulating a register. A deviation of a web tension from a set value changes the number of revolutions and/or the angular position of a first printing location in relation to a second printing location.

EP 0 950 519 A1 discloses a method for regulating the cutting and inking registers of several webs in respect to each other, as well as between individual print units. Expansions of the webs are determined by use of the operating points of the drive mechanisms of conveying rollers, active cylinders and traction rollers. Correcting values determined from this are added as position offsets to the command variables for the cutting register or the inking register.

SUMMARY OF THE INVENTION

The object of the present invention is directed to providing methods for regulating a circumferential register in a web-fed rotary printing press.

In accordance with the present invention, this object is attained by providing at least two printing units in the web-fed rotary press through which the web passes sequentially. An actual value of the tension in the web is determined. An angular position or speed of one cylinder of a first print unit, with respect to a cylinder of a second print unit, is regulated. The web tension is determined downstream of the last print unit, in the production direction. This tension is used to regulate the angular position or speed of a cylinder in a print unit upstream of this last print unit. A difference between the actual web tension and a set value can be determined and used to regulate the upstream cylinder. The change value of the cylinder may be formed as a function of web quality.

The advantages which can be obtained by the present invention reside, in particular, in that an error in the circumferential register, which error is the result of web tension fluctuations or of fluctuations of the circumference of the printing cylinder caused, for example, by brief changes in the thickness of the web, is counteracted without a great outlay for measuring and regulating. The error to be corrected can be a register offset, which is an error in the so-called inking register, or a register error between the two sides of the imprinted web. A difference in the conveying speed of the web occurring between two print positions is corrected by a change of the relative rotary position of the two print positions with respect to each other.

It is a great advantage of the present invention that it is possible to omit elaborate measurements and regulations by the use of ink markers applied to the web. Neither a direct measurement of the web expansion, nor a regulation of the web tension or torque by use of the operating points of the drive mechanisms of the print units, for the purpose of a correction, needs to be performed.

The method, and a corresponding device in accordance with the present invention, can be employed particularly advantageously in case of a register offset in print units with several double printing groups arranged one behind the other, or with one on top of the other for a rubber-against-rubber operation, such as in an eight-unit printing tower composed of two so-called H-print units, wherein at least two of the printing locations make successive imprints on the same location of a web.

For eight-unit towers, consisting of two H-printing groups, it is particularly advantageous to evaluate the chronological change of the tension of the web, for example before or after passing through a gluing station for the web, downstream of the last printing group, or the last print unit, and to perform only a change of the angular position of the H-print unit which is first in the running direction of the web in relation to the second H-print unit. This regulation of the circumferential register, and in particular of the ink register, is advantageous for several, for example for at least three print units through which a web successively passes, wherein a distance between the two first printing nips is clearly less than a subsequent distance from a third printing nip. An eight-unit tower, consisting of two H-print units, is an example for this.

The method in accordance with the present invention can be advantageously used for regulating the register between the two sides of the web in printing presses having satellite print units.

In one embodiment, the present invention is of particular advantage in that a chronological change of the tension downstream of the last print unit, i.e. a difference in the tension at a first point in time and at a second point in time, is used directly and linearly for the correction of the register offset of the second H-print unit in relation to the first H-print unit. This requires an extremely low measuring and regulating outlay, while still being sufficiently accurate.

It is possible, in an advantageous manner, to omit a tension regulation, for example by use of a moment-controlled traction roller downstream of the printing tower. An unregulated traction roller, with a controlled number of revolutions, is sufficient here. A register offset, for example caused in a gluing station, is corrected in an advantageous manner exclusively by use of the circumferential register of the cylinders, in particular the cylinders of the first print unit, or of the first two print units. It is possible, in particular, to regulate the two first print units, for example in the form of an H-print unit, together, so that it is merely necessary to determine a single correction value and to perform a single correction.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
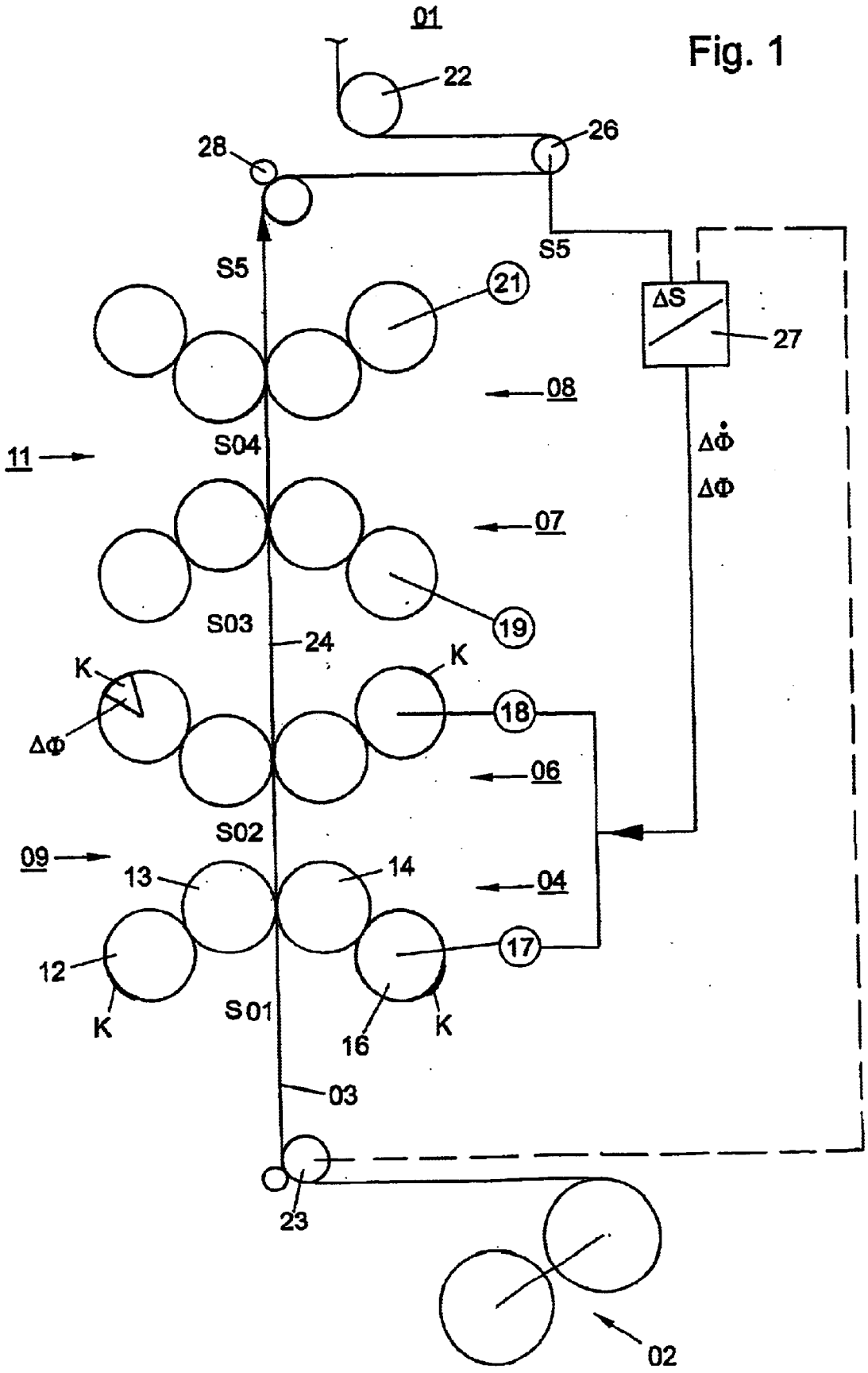
FIG. 1, a schematic side elevation view of a print unit with a roll changer in accordance with the present invention, in FIG. 2, a schematic representation of a web tension as a function of time in the course of a passage of the web through a gluing station, and in FIG. 3, a schematic representation of a correction value, or a value of a change in the angle of rotation, as a function of time.

A web-fed rotary printing press, as depicted schematically in FIG. 1, has, for example, an eight-unit printing tower 01 and a roll changer 02. During the printing operation, a web 03, for example a paper web 03, travels from the roll changer 02, for example via a draw-in device, which is not specifically represented, through the eight-unit tower 01.

The eight-unit tower 01 has a total of four print units 04, 06, 07, 08, which are identical and each of which has a printing nip. In the eight-unit tower 01, these four print units 04, 06, 07, 08 are embodied as double printing groups 04, 06, 07, 08, which work in a rubber-against-rubber operation during printing. Two of the print units 04, 06 are arranged within a first, lower, H-print unit 09, and the other two print units 07, 08 are arranged within a second, upper, H-print unit 11. Each one of the print units 04, 06, 07, 08 has at least three, and in the depicted configuration, has four cylinders 12, 13, 14, 16, for example a first forme cylinder 12, a first transfer cylinder 13 working together with the first forme cylinder 12, a counter-pressure cylinder 14 working together with the transfer cylinder 13 via the paper web 03, and, if the counter-pressure cylinder 14 is embodied, as it is here, as a second transfer cylinder 14, a second forme cylinder 16 working together with the latter.

In the eight-unit tower 01, each one of the print units 04, 06, 07, 08 has at least one drive motor 17, 18, 19, 21. However, each cylinder 12, 13, 14, 16 of each print unit 04, 06, 07, 08, or respectively each pair of transfer cylinders 13, 14 and forme cylinders 12, 16 together, can have a drive motor. It is however also possible that the first or lower H-print unit 09 constitutes a compound unit driven by drive motors 17, 18, and the second or upper H-print unit 11 constitutes a compound unit driven by drive motors 19, 21. A traction roller 22 is arranged downstream or after, in the direction of travel of web 03, the last print unit 08. A draw-in device 23, which is symbolized by a traction roller, is arranged between the roll changer 02 and the first print unit 04. Not specifically represented inking systems and, if required, dampening systems, are assigned to each of the print units 04, 06, 07, 08.

In the direction of travel of the paper web 03 from the roll changer 02 and as far downstream as the last print unit 08, viewed in the running direction of the paper web 03, of the eight-unit tower 01, various web tensions S1, S2, S3, S4, S5 exist. The web tension S1 is the tension in the web 03 upstream of the eight-unit tower 01, for example S1 lies between 30 and 50 daN/m. The web tension S2 is the tension in the web 03 between the print units 04 and 06. The tension S3 exists in the web 03 between the first H-print unit 09 and the second H-print unit 11. The tension S4 is the web tension between the print units 07 and 08, and downstream of the last print unit 06 the web tension is S5. For example, S5 lies between 10 and 20 daN/m, and in particular between 12 to 15 daN/m. The exact levels of the web tensions S1–S5, and the accurate differences between them, however, are based on the water sensitivity of the paper used. The considerably higher level of the tension S1 in comparison to S5 is essential. A regulation of the tension is performed, for example, by operation of the draw-in device 23.

In the course of passage of the web 03 through the eight-unit tower 01, the tension-expansion characteristics of the paper web 03 change as a result of moisture added by ink, and possibly by dampening agent. The tension levels upstream and downstream of the eight-unit tower 01 will advantageously be selected in such a way that an expansion of the web upstream and downstream of the eight-unit tower 01 is approximately equal. As a rule, the tension S1 is higher than the tension S5.

If now a change of a web roll takes place in the roll changer 02 under fixed production conditions, in particular by way of a flying change by gluing, a glued joint moves along with the paper web 03 from the roll changer 02 through the eight-unit tower 01. For example, the glued joint has an area of two layers of the paper web 03 and an adhesive layer, for example an adhesive strip. A so-called adhesive slip, i.e. an area of two paper layers, can extend far past the width of the glued joint. Therefore the paper web 03 has an area 24 of increased thickness which moves through the printing press.

As the area 24 of increased web thickness passes through a print unit 04, 06, 07, 08, an elastic cover on the cylinders 13, 14, for example rubber blankets, is slightly more compressed because of the increased web thickness and the fixed axial spacing distance of the cylinders 13, 14 working together. At a constant angular cylindrical speed, the circumferential speed of the cylinders 13, 14 is reduced. For example, the higher circumferential speed still prevails in the print unit 07, while simultaneously the circumferential speed in the print unit 06 is reduced during the passage of the area 24 of increased web thickness. Thus, the level of the tensions S2, S3, S4, S5 suddenly increases between the print units 04, 06, 07, 08 and downstream of the eight-unit tower 01. This sudden increase in web tension is depicted in FIG. 2 regarding the tension S5.

The increased level of the tensions S2, S3, S4, S5 is accompanied by an increased level of the expansion of the paper web 03, and therefore causes a register offset $\Delta P$ in the circumferential direction between the individual print units 04, 06, 07, 08, which is a so-called register offset in the circumferential register.

The sudden increase of the tensions S2, S3, S4, S5, and therefore also of the expansion of the paper web 03, is a function of the original level of the tensions S1, S2, S3, S4. S5, and in particular of a difference between tensions S1 and S5, and of the length of the adhesive tail, i.e. of the length of the area 24 of increased web thickness. The latter, in particular is a factor in connection with staggered cylinders, i.e. cylinders with several channels on a shell surface of a cylinder, which channels are arranged next to each other in the axial direction, but which are offset in respect to each other in the circumferential direction. If, in this case, the length of the adhesive tail is greater than or is equal to the distance between the channels in the circumferential direction, a partial relief can take place.

Figure 2:
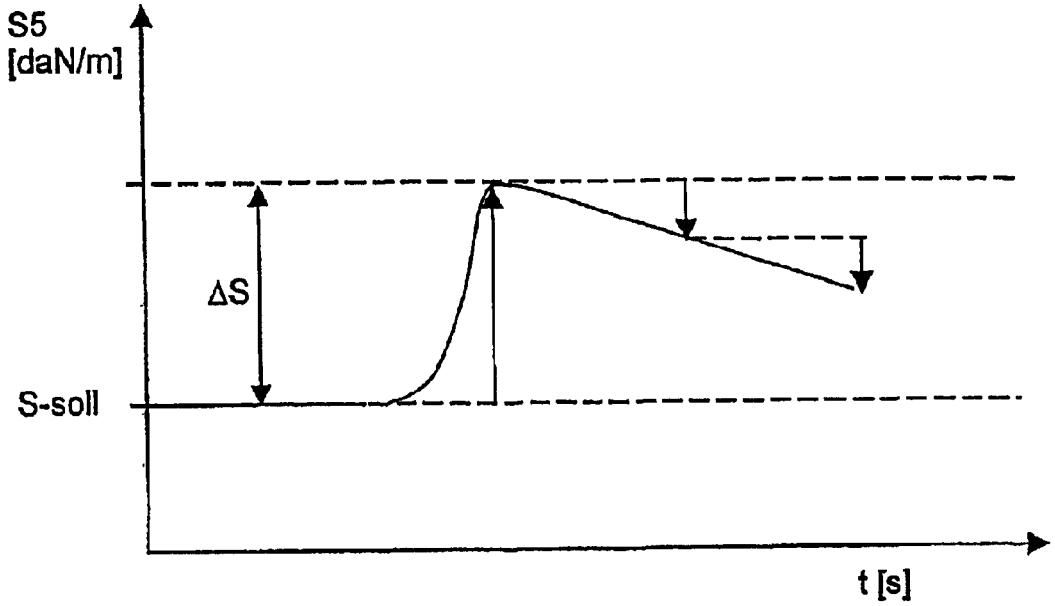

The sudden increase of the tension S2, S3, S4, S5, in particular of the tension S5, over a set value S-soll downstream of the eight-unit tower 01, for example by a difference $\Delta S$, as depicted in FIG. 2 before and after the passage of the area 24 of increased web thickness, is detected by a measuring device 26 and a regulating device 27 and is further processed.

A correction value K is determined from this difference $\Delta S$, and the register offset $\Delta P$, which had occurred between two print units 04, 06, 07, 08, or between two H-print units 09, 11. As a rule, this compensation takes place by a relative change $\Delta\phi$ of an angular position $\phi$, for example the angle of rotation position $\phi$, of the H-print units 09, 11 under consideration, or of the cylinders 12, 13, 14, 16 of the print units 04, 06, 07, 08 under consideration, with respect to each other.

Figure 3:
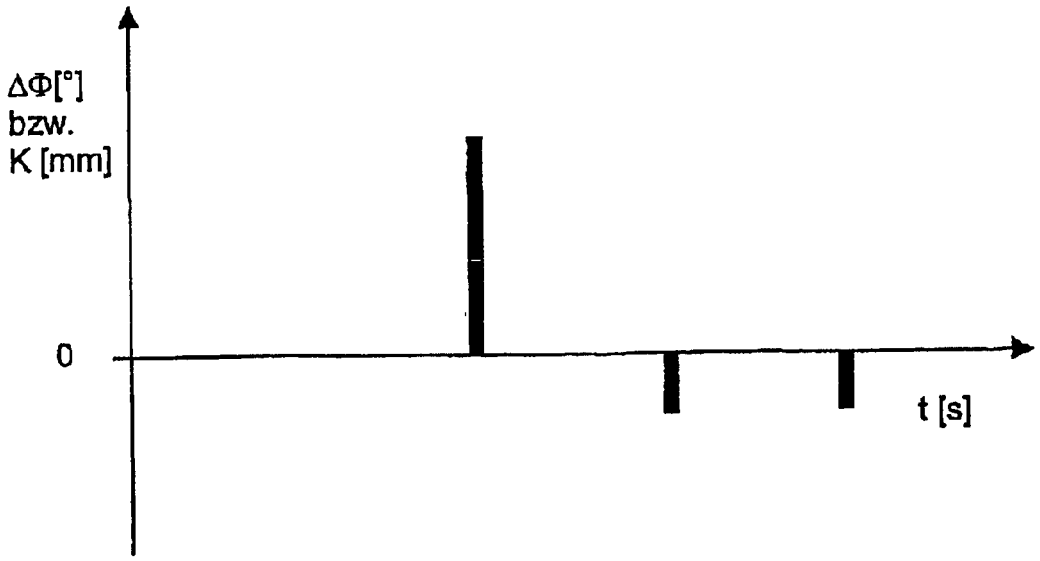

In the depicted example, the tension S5 is determined by a tension measuring device 26, for example a sensor 26 such as, for example, a measuring roller 26, which is situated downstream of the eight-unit tower 01, in this case following a capture roller 28, and is fed to the regulating device 27, which may be a computer 27, or to a control station computer 27. From the difference ΔS, the regulating device 27, or the computer 27, determines the mean correction value between the lower H-print unit 09 and the upper H-print unit 11. The angle of rotation position ϕ of the lower H-print unit 09, and, in particular, that of the forme cylinders 12, 16 of the print units 04 and 06, is now rotated by a corresponding change Δϕ of the angle of rotation ϕ in relation to the lower H-print unit 09, in particular the forme cylinders 12, 16 of the latter. The registration offset ΔP, which had occurred, is corrected in this way. Since, in the depicted and discussed example, no tension regulation occurs by use of the traction roller 22, or of another arrangement, such as, for example, a compensation roller, downstream of the last print unit 08 as far as the included traction roller 22, the tension S5 slowly drops in the course of the further conveyance of the paper web 03 through the print units 04, 06, 07, 08. In the course of the slow tension drop, the circumferential register is corrected in the opposite direction by the correction value K in accordance with the changing difference ΔS between S5 and S-soll, as depicted in FIG. 3. In an advantageous manner, this does not take place continuously, but at suitable intervals.

In the present preferred embodiment of the eight-unit tower 01, no correction between the two adjoining print units 04, 06, or 07, 08, each two adjoining print units being assigned to the same H-print unit 09, 11, respectively, is performed, only a relative angle of rotation position ϕ between the lower and upper H-print unit 09, 11 is taken into consideration as a change Δϕ in the angle of rotation position ϕ. In the course of this, the relative angle of rotation position ϕ of at least one cylinder, and in case of double printing groups 04, 06 of at least two cylinders 12, 13, 14, 16, in an advantageous manner of the respective forme cylinders 12, 16, is changed. The deviation between the print units 04, 06, or 07, 08 assigned to a single H-print unit 09, 11, lies within the permissible tolerances for a deviation in the registration, particularly in connection with newspaper printing.

The regulation of the circumferential register, in accordance with the present invention, is generally advantageous for at least three or more print units 04, 06, 07, 08 arranged one behind the other, wherein a first distance a1 of, for example, 0.4 m to 1 m between the first two printing nips 04, 06 is clearly less than a second, subsequent distance a2 of, for example, >1 m to a third printing nip 07. An example of this is the eight-unit tower 01 consisting of two H-print units 09, 11. The effects of moisture, and therefore a tension-caused register offset ΔP, is less, in particular on the path between the first two print units 04, 06, which follow each other at the short first distance a1, so that the regulation for the first two print units 04, 06 in relation to the upper print unit 07, 08 can take place in the same way, and not additionally in relation to each other. A shorter third distance a3 of, for example, 0.4 m to 1 m follows the second distance a2 and is the distance between the two print units 07, 08 of the upper H-print unit 11. A relative change takes place only at the print units 04, 06, with a large distance a2 to a subsequent print unit 07.

The regulation of the correction of the register offset ΔP by use of the correction value K as a function of the difference ΔS, consisting of the initially spontaneously rising and subsequently falling change of the web tension S5 by a difference ΔS, is preferably performed as a proportional regulation, wherein a linear connection is preferably made between the difference ΔS of the tension S5 and the correction value K. In an advantageous manner, the regulating device 27 is embodied as a proportional regulator 27.

In a preferred embodiment, the correction value K essentially satisfies, in the range of the tensions S1–S5 and ΔS considered here the equation K=a*ΔS, wherein a represents the slope or pitch, and no constant member needs to be considered. For regulating the lower H-print unit 09 with respect to the upper H-print unit 11, the slope or pitch a for the eight-unit tower 01 under consideration lies between 1/(35 daN/m/mm) and 1/(45 daN/m/mm), and in particular around 1/(40 daN/m/mm) if the difference ΔS of the tension S5 is measured in daN/m, and the correction value K of the register offset ΔP on the circumference of the cylinder 12, 13, 14, 16 is measured in mm.

For example, if a measured difference ΔS of the web tension S5 for a cylinder diameter of approximately 230 mm is 10 daN/m, the angle of rotation position ϕ for the lower H-print unit 09 relative to the upper H-print unit 11 is corrected in such a way that an offset at the circumference of the changed cylinders 12, 13, 14, 16 by approximately 0.25 mm takes place. The change Δϕ of the angle of rotation position is proportional to the correction value K and to the register offset ΔP. Therefore, the change Δϕ of the angle of rotation position over a constant c considered over the circumference of the respective cylinders, 12, 13, 14, 16 also is in a linear correlation to the difference ΔS, therefore Δϕ=a*c*ΔS applies for the value of the change of the relative angle of rotation position. The relative change Δϕ for the upper cylinder therefore is approximately 0.12° to 0.13°, for example. In place of the change Δϕ of the angle of rotation position, a change of the angular speed Δϕ can take place for a set time.

A different dependency of the correction to be taken into consideration exists for different qualities of the paper web 03, so that preferably a quality value Questions, or also a quality function Questions, for taking into consideration the existing type of paper web 03, such as moisture behavior and/or tension-expansion characteristics, etc. should be superimposed on the previously discussed dependency. The desired correction by the correction value K, or the change Δϕ of the angle of rotation position ϕ or the angular speed Δϕ is therefore a function of the tension S5, or the difference ΔS of the circumference of the cylinder 12, 13, 14, 16 to be corrected and the quality value Q.

In a preferred embodiment, the correction of the register offset ΔP is only performed by a register adjustment. A regulation of the tension S5 downstream of the last print unit 08 is not performed in this connection. In a preferred embodiment, the traction roller 22 is designed as a traction roller 22 which is regulated in respect to its number of revolutions, to which neither tension values nor torque values need to be assigned. The measured tension S5 is used in an advantageous manner for regulating the tension S1, in a manner shown in dashed lines in FIG. 1, in order to meet the previously discussed requirement of a greater tension S1 in comparison to S5.

The method, and a corresponding device, for regulating the circumferential register for correcting the register offset ΔP, which occurs during the fixed printing operation in the form of short interferences, is particularly suitable, for example because of the flying change of paper rolls of identical quality. Following this interference, fixed conditions and the identical paper quality prevail as a rule.

In an advantageous embodiment of the present invention, each cylinder 12, 13, 14, 16 of each print unit has its own drive motor 17, 18, 19, 20. For the correction of the registration offset ΔP, however, all drive motors 17, 18 of one of the two print units 04, 06, or all drive motors 17, 18 of the two lower print units 04, 06 are corrected simultaneously by the same value. What has been said should be correspondingly applied for a drive mechanism for each pair of forme cylinders 12, 16 associated with their assigned transfer cylinders 13, 14.

The method for regulating the circumferential register in accordance with the present invention is also suitable for configurations of a printing press other than that of the depicted eight-unit tower 01 with at least two print units 04, 06, 07, 08, provided that the other printing press configuration has several printing nips 04, 06, 07, 08, or print units 04, 06, 07, 08, which are spaced apart from each other in the running direction of the paper web 03, or has several spaced printing locations 04, 06, 07, 08.

For example, the other configuration can be a printing press which has several bridge units that are arranged one on top of each other, or which has several rubber-against-rubber print units, which are arranged next to each other, with a horizontal guidance of the paper web 03. In the same way, for all of the recited examples, the respective first transfer cylinder 13 can also work in cooperation with a counter-pressure cylinder 14, which may be embodied as a steel cylinder 14. Here, too, the tension S5 is measured downstream of the last print unit 08, and the print units 04, 06, 07, which are arranged upstream of the last print unit 08, are arranged by the difference ΔS, or the tension S5. This can again occur in groups of several successive print units 04, 06, or also with individual print units 04, 06, 07. In principle, the print units 04, 06, 07 are regulated with respect to the unchanged last print unit 08. As a rule, no relative change needs to take place between the first and second print units 04, 06, because the web which passes between them is not yet completely moistened throughout.

In addition to the method for controlling a circumferential register, or the ink register, i.e. for controlling the exact relative position of two print images which are imprinted one after the other on the same side of the web 03, and as a rule in different colors, the method of the present invention is also suited to regulate the register between two sequentially imprinted sides of a web 03. This register regulation is advantageous, for example, for an arrangement of two satellite print units 09, 11, each having one or several print positions. The web 03 passes successively through the satellite print units 09, 11 which are, each for example, embodied as so-called nine-cylinder satellites or ten-cylinder satellites, wherein one side of the web 03 is imprinted in one of the print units 09, 11, and thereafter the other side of the web 03 is imprinted in the other print unit 11, 09, in one or in several colors.

For separate requirements, the measurement and evaluation of the difference ΔS in the tension S2, S3, S4, S5 can also take place between the individual nips 04, 06, 07, 08, and a change in the rotary position of the previous nips 04, 06, 07, 08 can be caused.

In case of greater differences ΔS within a large tension range of the tensions S2, S3, S4, S5, it is possible, under certain circumstances, to base the difference ΔS and the required correction of the register offset ΔP by the correction value K on a non-linear connection. However, in this case a corresponding functional connection can also be taken into consideration in the regulating device in a simple manner.

While preferred embodiments of a method for controlling a circumferential register in a web-fed rotary printed press in accordance with the present invention have been set forth fully and completely hereinabove, it will be apparent to one of skill in the art that various changes in, for example the specific structures of the cylinders, the specific types of cylinder drive motors used, and the like, could be made without departing from the true spirit and scope of the present invention which is accordingly to be limited only by the following claims.

What is claimed is:

1. A method for regulating a circumferential register in a web-fed rotary printing press, including:

providing at least first and second print units arranged sequentially in the printing press in a production direction, said at least first and second print units each including at least one forme cylinder and at least one transfer cylinder;

providing a web to be printed and traveling in a web travel direction sequentially through said at least first and second print units;

measuring an actual value of a tension in said web at a location after, in said web travel direction, a last, in said production direction, print unit in said printing press;

providing means for regulating at least one of a cylinder angular position and an angular speed of at least one of said at least one forme cylinder and said at least one transfer cylinder of said first print unit with respect to at least one of an angular position and an angular speed of at least one of said at least one forme cylinder and said at least one transfer cylinder of said second print unit; and using said actual value of said tension for regulating at least one of said angular position and an angular speed of at least one of said at least one forme cylinder and said at least one transfer cylinder of said first print unit for correcting the tension in said web.

2. The method of claim 1 further including providing a set value for said web tension, determining a difference between said actual value of said web tension and said set value for said web tension and using said web tension difference for changing at least one of said angular position and angular speed.

3. The method of claim 1 further including providing a web quality value and using said web quality value for changing at least one of said angular position and angular speed.

4. The method of claim 1 further including using said actual value of a tension in said web for changing at least one of said angular position and angular speed of a first one of said print units in said production direction.

5. The method of claim 1 further including using said actual web tension for changing at least one of said angular position and angular speed of cylinders of first and second ones of said at least first and second print units.

6. The method of claim 5 wherein at least one of said angular position and said angular speed in said first and second print units are changed by the same amount.

7. The method of claim 2 further including providing said first and second print units as a first H-printing unit and providing at least a second H-printing unit arranged downstream of said first H-printing and changing at least one of said angular position and said angular speed of cylinders of said first and second print units.

8. The method of claim 3 further including providing said first and second print units as a first H-printing unit and providing at least a second H-printing unit arranged downstream of said first H-printing and changing at least one of said angular position and said angular speed of cylinders of said first and second print units.

9. The method of claim 1 wherein said web fed rotary printing press is provided having two H-print units.

10. The method of claim 2 further including determining a linear relationship between said web tension difference and said change of at least one of said angular position and said angular rotation and using said linear relationship for forming a change value.

11. The method of claim 1 further including providing a roll changer before a first one of said at least first and second print units and changing a web tension between said roll changer and said first print unit.

12. The method of claim 1 further including setting said web tension before said first print unit higher by at least 10 daN/m than said web tension after a last print unit.

13. The method of claim 1 further including correcting a register offset in said web using said web tension.

14. The method of claim 1 further including providing a traction roller located downstream of at least one of said print units and regulating said traction roller to a constant number of revolutions.

15. The method of claim 2 further including using said web tension difference for changing at least one of said angular position and said angular speed in a first direction in response to an increase in said web tension difference and in a second direction in response to a decrease in said web tension difference.

16. A method for regulating a circumferential register in a web-fed rotary printing press including:

providing a first print unit having at least first and second print locations;

providing a second print unit having at least third and fourth print locations, said first and second print units each including at least one forme cylinder and at least one transfer cylinder;

passing a web to be printed and traveling in a web travel direction through said first print unit and said second print unit;

determining an actual value of a tension in said web downstream, in said web travel direction, a last printing location;

providing a set value of said tension in said web;

determining a tension difference between said actual value and said set value of said tension in said web;

using said tension difference for regulating an angular position of at least two cylinders in said first print unit with respect to at least one cylinder of said second print unit wherein said at least two cylinders in said first print unit are regulated by the same value.

17. The method of claim 16 wherein said web fed rotary printing press is provided having two H-print units.

18. The method of claim 16 further including providing said web-fed rotary printing press having two satellite print units.

19. The method of claim 16 further including providing a web quality value and using said web quality value together with said tension difference for regulating said at least one of said angular position and said angular speed.

20. The method of claim 16 further including determining a linear relationship between said web tension difference and said change of at least one of said angular position and said angular rotation and using said linear relationship for forming a change value.

21. The method of claim 16 further including providing a roll changer before a first one of said at least first and second print units and changing a web tension between said roll changer and said first print unit.

22. The method of claim 16 further including setting said web tension before said first print unit higher by at least 10 daN/m than said web tension after a last print unit.

23. The method of claim 16 further including correcting a register offset in said web using said web tension.

24. The method of claim 16 further including providing a traction roller located downstream of at least one of said print units and regulating said traction roller to a constant number of revolutions.

25. The method of claim 16 further including using said web tension difference for changing at least one of said angular position and said angular speed in a first direction in response to an increase in said web tension difference and in a second direction in response to a decrease in said web tension difference.

* * * * *